US008854406B1

(12) United States Patent
Mesropyan et al.

(10) Patent No.: US 8,854,406 B1
(45) Date of Patent: Oct. 7, 2014

(54) COLLECTIVE MARKING OF A SURFACE BY STEERING MULTIPLE LASER BEAMS GENERATED BY A LASER CONTROLLER

(71) Applicants: Ashot Mesropyan, Fremont, CA (US); Michael Watts, Union City, CA (US)

(72) Inventors: Ashot Mesropyan, Fremont, CA (US); Michael Watts, Union City, CA (US)

(73) Assignee: Telesis Technologies, Inc., Fremont, CA (US)

( * ) Notice: Subject to any disclaimer, the term of this patent is extended or adjusted under 35 U.S.C. 154(b) by 0 days.

(21) Appl. No.: 14/097,273

(22) Filed: Dec. 5, 2013

Related U.S. Application Data

(60) Provisional application No. 61/807,238, filed on Apr. 1, 2013.

(51) Int. Cl.
*B41J 2/435* (2006.01)
*B41J 2/47* (2006.01)
*B41J 27/00* (2006.01)

(52) U.S. Cl.
CPC ..... *B41J 2/47* (2013.01)
USPC ..... 347/224; 347/225; 347/235; 347/244; 347/256; 347/258; 347/260

(58) Field of Classification Search
USPC ..... 347/224–5, 235, 244, 256, 258, 260
See application file for complete search history.

(56) References Cited

U.S. PATENT DOCUMENTS

| | | | | |
|---|---|---|---|---|
| 6,366,385 | B2 | 4/2002 | Kimura | |
| 7,379,221 | B2 | 5/2008 | Saito | |
| 7,436,425 | B2 | 10/2008 | Yamazaki et al. | |
| 8,305,413 | B2 | 11/2012 | Aoyama et al. | |
| 2008/0279232 | A1 * | 11/2008 | Sung | 372/24 |

* cited by examiner

*Primary Examiner* — Sarah Al Hashimi
(74) *Attorney, Agent, or Firm* — Raj Abhyanker, P.C.

(57) ABSTRACT

Disclosed are methods, systems, and/or apparatus for the collective marking of a surface by two or more laser beams generated by a laser controller. A method includes receiving one or more input signals from a controller of the laser system. The method also includes adjusting a first mirror through a first galvanometer scanner, a second minor through a second galvanometer scanner, a third mirror through a third galvanometer scanner, and a fourth mirror through a fourth galvanometer scanner based on the one or more input signals. The method further includes steering, through the first mirror and the second mirror, a first laser beam generated by the controller and transmitted to a marking head through a beam delivery vessel; and steering, through the third mirror and the fourth minor, a second laser beam generated by the controller and transmitted to the marking head through another beam delivery vessel.

20 Claims, 11 Drawing Sheets

COLLECTIVE MARKING OF A SURFACE BY STEERING MULTIPLE LASER BEAMS GENERATED BY A LASER CONTROLLER

CLAIM OF PRIORITY

This application is a non-provisional application claiming priority to U.S. Provisional Patent Application Ser. No. 61/807,238 titled: "SIMULTANEOUS MARKING OF A SURFACE BY MULTIPLE LASER BEAMS STEERED BY MULTIPLE SCAN HEADS OF A LASER SYSTEM," filed on Apr. 1, 2013.

FIELD OF TECHNOLOGY

This disclosure relates generally to laser marking systems and, more particularly, to a method, system, and/or apparatus for the collective marking of a surface by two or more laser beams generated by a laser controller.

BACKGROUND

Presently, most laser marking devices utilize a single scan head in order to carry out tasks such as the marking of objects. The utilization of a single scan head for marking an object may consume an inordinate amount of time during a single production cycle. For production cycles that require a shorter marking time, laser systems with a single scan head may not be ideal. Furthermore, purchasing additional laser marking devices to shorten the cycle time may not be cost effective. If multiple laser marking devices are used, coordinating the devices may be a difficult process and may not be error-free. Further yet, current systems that use multiple scan heads may not provide a facility to modify individual laser beam characteristics (e.g. pulse duration, pulse energy, wavelength, etc.) to produce unique marking depths, marking profiles, and/or marks that differ from one another. Additionally, systems that use multiple scan heads may not provide the facility to converge multiple laser beams to generate a deeper mark and/or a mark with a unique profile in less time than it would take a single laser beam.

SUMMARY

Disclosed are a method, system, and/or apparatus for the collective marking of a surface by two or more laser beams generated by a laser controller.

In one aspect, a method of a marking head of a laser system comprises receiving one or more input signals from a controller of the laser system coupled to the marking head through at least one interface cable, wherein the controller generates the one or more input signals based on input data received from a data processing device communicatively coupled to the controller. The method further comprises adjusting a first minor through a first galvanometer scanner, a second minor through a second galvanometer scanner, a third mirror through a third galvanometer scanner, and a fourth minor through a fourth galvanometer scanner based on the one or more input signals.

In addition, the method involves steering, through the first minor and the second mirror, a first laser beam generated by the controller and transmitted to the marking head through a beam delivery vessel and steering, through the third minor and the fourth mirror, a second laser beam generated by the controller and transmitted to the marking head through another beam delivery vessel. The first galvanometer scanner, the second galvanometer scanner, the third galvanometer scanner, and the fourth galvanometer scanner are configured by the one or more input signals to steer the first laser beam and the second laser beam such that the first laser beam and the second laser beam collectively mark a marking surface.

In another aspect, a laser marking system to mark a marking surface comprises a controller, a data processing device communicatively coupled to the controller, and a marking head coupled to the controller through at least one interface cable. The marking head further comprises a first mirror of a first galvanometer scanner, a second minor of a second galvanometer scanner, a third minor of a third galvanometer scanner, and a fourth minor of a fourth galvanometer scanner.

In particular, the marking head is configured to receive one or more input signals from the controller, wherein the controller generates the one or more input signals based on input data received from the data processing device. The marking head is additionally configured to adjust the first mirror through the first galvanometer scanner, the second mirror through the second galvanometer scanner, the third mirror through the third galvanometer scanner, and the fourth minor through the fourth galvanometer scanner based on one or more input signals. The marking head is also configured to steer, through the first mirror and the second minor, a first laser beam generated by the controller and transmitted to the marking head through a beam delivery vessel and, through the third mirror and the fourth mirror, a second laser beam generated by the controller and transmitted to the marking head through another beam delivery vessel.

The first galvanometer scanner, the second galvanometer scanner, the third galvanometer scanner, and the fourth galvanometer scanner are configured by the one or more input signals to steer the first laser beam and the second laser beam such that the first laser beam and the second laser beam collectively mark the marking surface.

The input data received from the data processing device comprises data instructing the controller to configure the one or more input signals based on a laser beam steering mode, wherein the laser beam steering mode involves the generation of a mark made through a convergence of the first laser beam and the second laser beam at a convergence point on the marking surface and/or two marks made at around the same time, wherein one mark is created by the first laser beam and another mark is created by the second laser beam. In particular, the convergence point lies within an area of overlap, wherein the area of overlap is a region on the marking surface where both the first laser beam and the second laser beam can be steered to mark the marking surface.

The methods and systems disclosed herein may be implemented in any means for achieving various aspects, and may be executed in a form of a non-transitory machine-readable medium embodying a set of instructions that, when executed by a machine, cause the machine to perform any of the operations disclosed herein. Other features will be apparent from the accompanying drawings and from the detailed description that follows.

BRIEF DESCRIPTION OF THE DRAWINGS

The embodiments of this invention are illustrated by way of example and not limitation in the figures of the accompanying drawings, in which like references indicate similar elements and in which.

Other features of the present embodiments will be apparent from the accompanying drawings and from the detailed description that follows.

DETAILED DESCRIPTION

Disclosed are methods, systems, and/or apparatus for the collective marking of a surface by two or more laser beams generated by a laser controller. Although the present embodiments have been described with reference to specific example embodiments, it will be evident that various modifications and changes may be made to these embodiments without departing from the broader spirit and scope of the various embodiments. Moreover the components shown in the figures, their connections, couplings, relationships, and functions are meant to be exemplary only and are not meant to limit or restrict the embodiments described herein. The following terms should be understood by one of ordinary skill in the art as industry terms: "laser beam(s)," "steering," "marking head," "scan head," "galvanometer scanner," "beam collimation/collimator(s)," and "marking on the fly." These terms are used according to their industry definitions, unless specified otherwise.

For the purpose of this disclosure, a "mark" is created by a laser marking system. The mark may be an engraving. Alternatively, the mark may be created through an annealing process or through any other material processing methods.

To explicate what a mark may constitute, an engraved mark is employed in the following example. A mark may collectively describe the character(s) that are engraved onto a surface at one time. For example, an entire engraving of a vehicle identification number (VIN) that consists of 17 characters may be designated as a mark. Each individual character is one part of the mark. Furthermore, a mark may also describe an image or images that are engraved onto a surface. In other instances, a mark may describe the specific engraving created by a single laser beam. If two laser beams are deployed to engrave a VIN such that one laser beam engraves the first 8 characters of the VIN while the second laser beam engraves the last 9 characters of the VIN, each set of characters engraved by each individual laser beam may be designated as a mark.

A laser marking system may be utilized to mark surfaces with information such as manufacturers' names, part numbers, model numbers, etc. However, when this process is accomplished on an assembly line, there is a need for quick, efficient, and accurate marking of objects. The utilization of a laser system with a single laser in such a situation may not be adequate for reaching production goals or quotas. Under these or other circumstances, a laser system with multiple lasers (e.g., two or more lasers) may expedite the marking process. An embodiment of such a laser system is depicted in FIG. 1.

Figure 1:
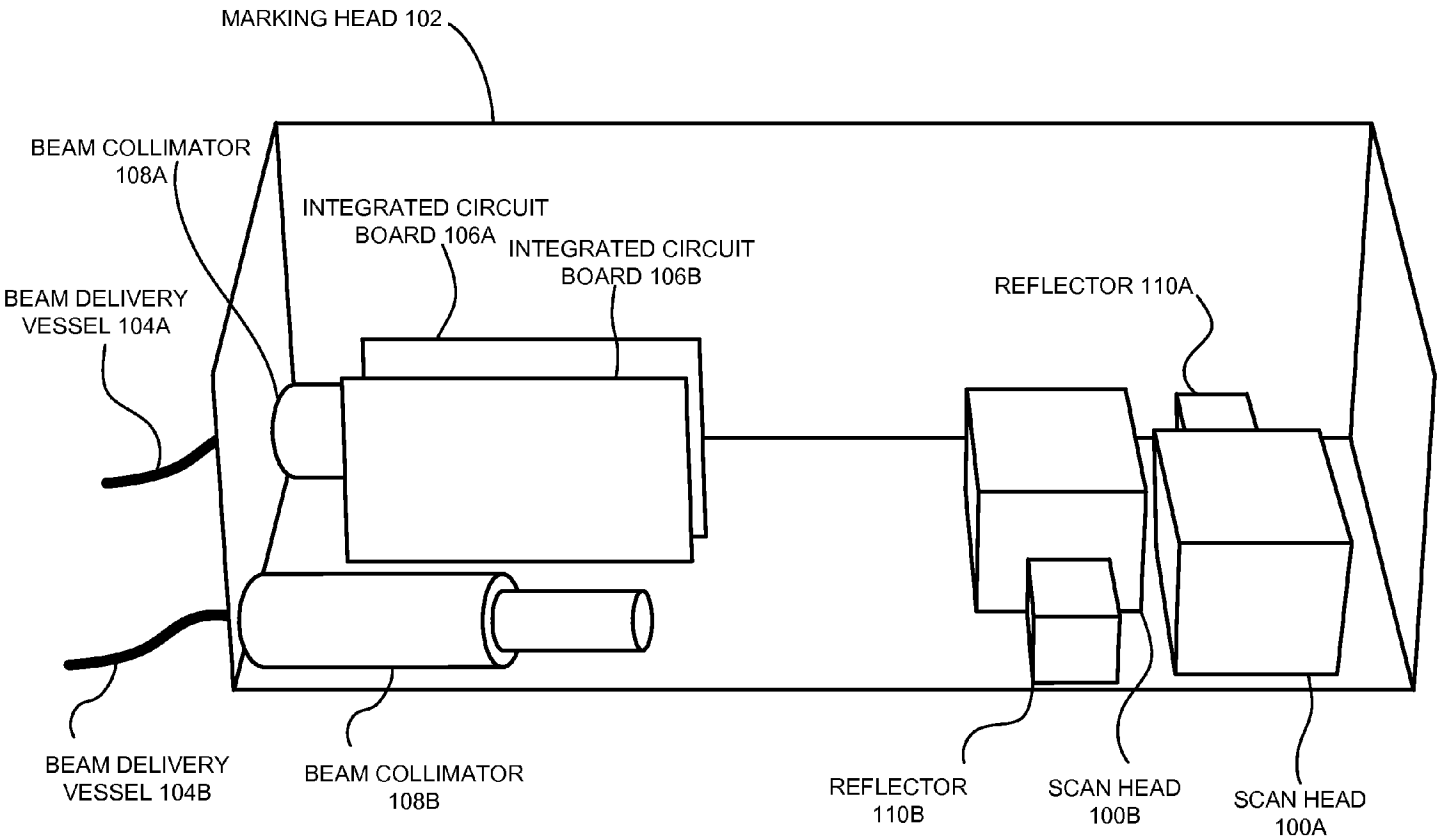
FIG. 1 illustrates a marking head of a laser system comprising two scan heads for the independent steering of two laser beams, according to one or more embodiments.

In particular, FIG. 1 illustrates a marking head 102 of a laser system comprising two scan heads 100A-B for the independent steering of two laser beams, according to one or more embodiments. In addition to the scan heads 100A-B, the marking head 102 may house two beam collimators 108A-B; two integrated circuit boards 106A-B; and/or two reflectors 110A-B. FIG. 1 illustrates a preferred embodiment of the arrangement of the above listed components of the marking head 102; however, different arrangements are within the scope of this exemplary embodiment.

The exemplary embodiment described herein may be utilized for marking stationary objects and/or moving objects. The marking of moving objects (e.g., marking on the fly) may be accomplished through the use of additional encoded signals that provide information to the laser system regarding a speed of the moving objects.

The scan heads 100A-B may be pre-manufactured scan heads utilized in the industry, such as the SCANcube® 10. The scan heads 100A-B may each further comprise multiple galvanometer scanners (not shown). Attached to a galvanometer scanner may be a minor (not shown). The use of two galvanometer scanners per scan head enables the deflection of a beam off of each mirror and the subsequent focusing of the beam through a scan lens (e.g., F-Theta objective) of the scan head. The mirrors may be tiltable such that the deflection angles can be adjusted based on the positions of the galvanometer scanners.

Figure 2A:
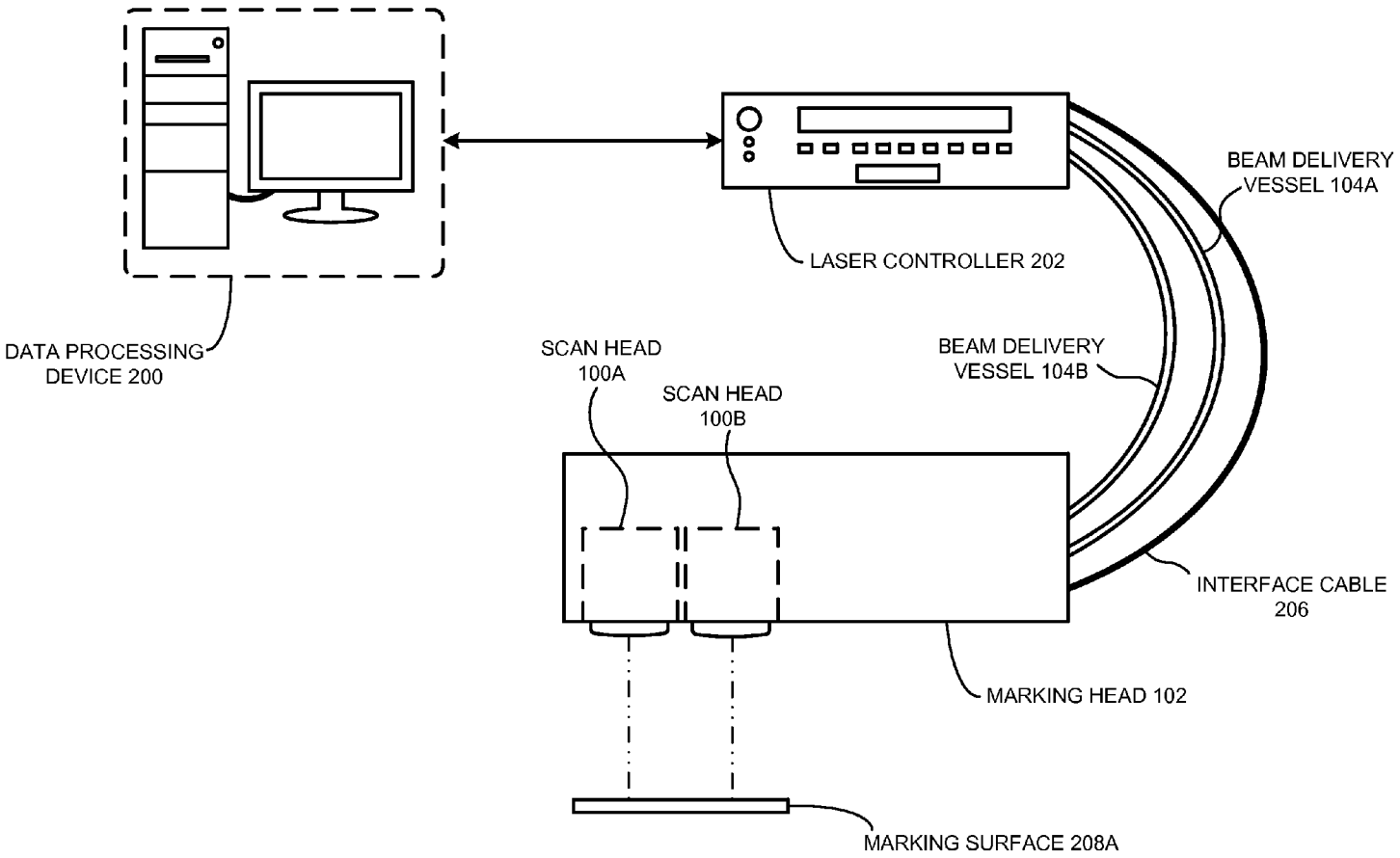
FIG. 2A is a schematic diagram of a laser system comprising a data processing device coupled to a laser controller, which in turn is communicatively coupled to a marking head, according to one or more embodiments.

Prior to the reflection of the laser beams off of the reflectors 110A-B, the laser beams may be delivered to the beam collimators 108A-B through two separate beam delivery vessels 104A-B, where the beams are conditioned and focused according to predetermined values. The beam delivery vessels 104A-B may be coupled to the beam collimators 108A-B at one end and to a laser controller 202 at the other end, as depicted in FIG. 2A. Specifically, FIG. 2A is a schematic diagram of a laser system comprising a data processing device 200 coupled to a laser controller 202, which in turn is coupled to the marking head 102, according to one or more embodiments.

The data processing device 200 may be communicatively coupled (e.g., via a wired data connection and/or a wireless data connection) to the laser controller 202. Furthermore, the wireless data connection may be facilitated through the use of a cloud network, which may comprise a cloud server to handle cloud computing (e.g., transmitting data signal(s) to the laser controller 202 through the World Wide Web) as necessary. The data processing device 200 may transmit a data signal to the laser controller 202 based on a user input.

The laser controller 202 may convert the data signal into digital input signals that are transmitted to the marking head 102 via an interface cable 206. The transmission of data may follow a particular protocol. For example, the digital input signals may comprise a set of values for the X axis and/or Y axis for the position of a minor of a galvanometer scanner. This type of data transmission is according to the XY2-100 protocol. The position of the galvanometer scanners may then be altered based on the values for the X and/or Y axes.

Concurrent with or at a different time than the transmission of the digital input signals, the beams are delivered from the laser controller 202 to the marking head 102, specifically into the beam collimators 108A-B. Subsequently, beam collimator 108A directs a beam to a reflector 110A that reflects the beam onto the minors of the galvanometers scanners in the scan head 100A. Similarly, beam collimator 108B delivers a separate beam to a reflector 110B that reflects the beam onto the minors of the galvanometer scanners in the scan head 100B.

One pair of galvanometer scanners may steer, through the mirrors, a beam to be focused onto a marking surface 208A. In a preferred embodiment, the two beams are steered at approximately the same time such that they come in contact with the marking surface 208A at around the same time. This may allow the beams to collectively mark the marking surface 208A. In one exemplary embodiment, the collective marking by the two beams is such that the marking surface 208A is marked by both beams at approximately the same time.

Figure 3A:
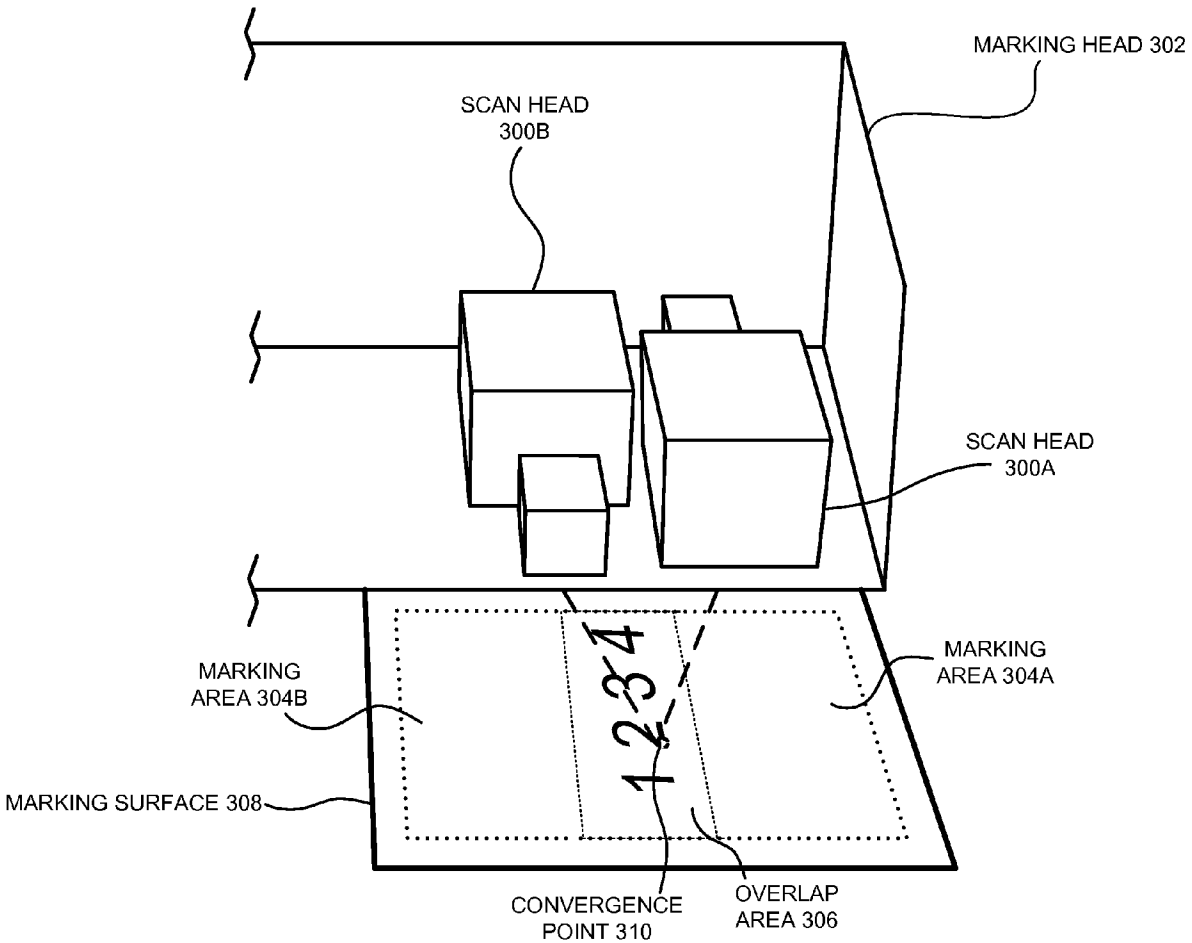
FIG. 3A is a cross-sectional view of a marking head comprising two scan heads that steer two laser beams that converge on a point of the marking surface, according to one or more embodiments.

According to one or more embodiments, the collective marking by the two beams may be according to one of two laser beam steering modes. The input data provided by the data processing device 200 may determine the specific laser beam steering mode to be employed. In particular, the digital input signals generated by the laser controller 202 may be based on a laser beam steering mode. According to one laser beam steering mode, the mark created is a result of the convergence of the two laser beams at a convergence point 310 on a marking surface 308, as shown in FIG. 3A. Accordingly, a single mark may be generated in an overlap area 306 of a marking area 304A and a marking area 304B. Specifically, the marking area 304A may be the area of the marking surface 308 where the laser beam steered by scan head 300A of a marking head 302 can mark the marking surface 308. Analogously, the marking area 304B may be the area of the marking surface 308 where the laser beam steered by scan head 300B of the marking head 302 can mark the marking surface 308.

According to one or more embodiments, the convergence point 310 may be located within the overlap area 306. The laser beams may be steered through the scan heads 300A-B such that they converge at the convergence point 310. Subsequently, the laser beams may collectively mark the marking surface 308. Reference is now made to FIG. 3A, which depicts the convergence of the two laser beams at the convergence point 310. In particular, the two laser beams are collectively marking the marking surface 308 to create a mark that reads "1234". The two laser beams converge within the overlap area 306 in order to mark "1234" on the marking surface 308.

Figure 7:
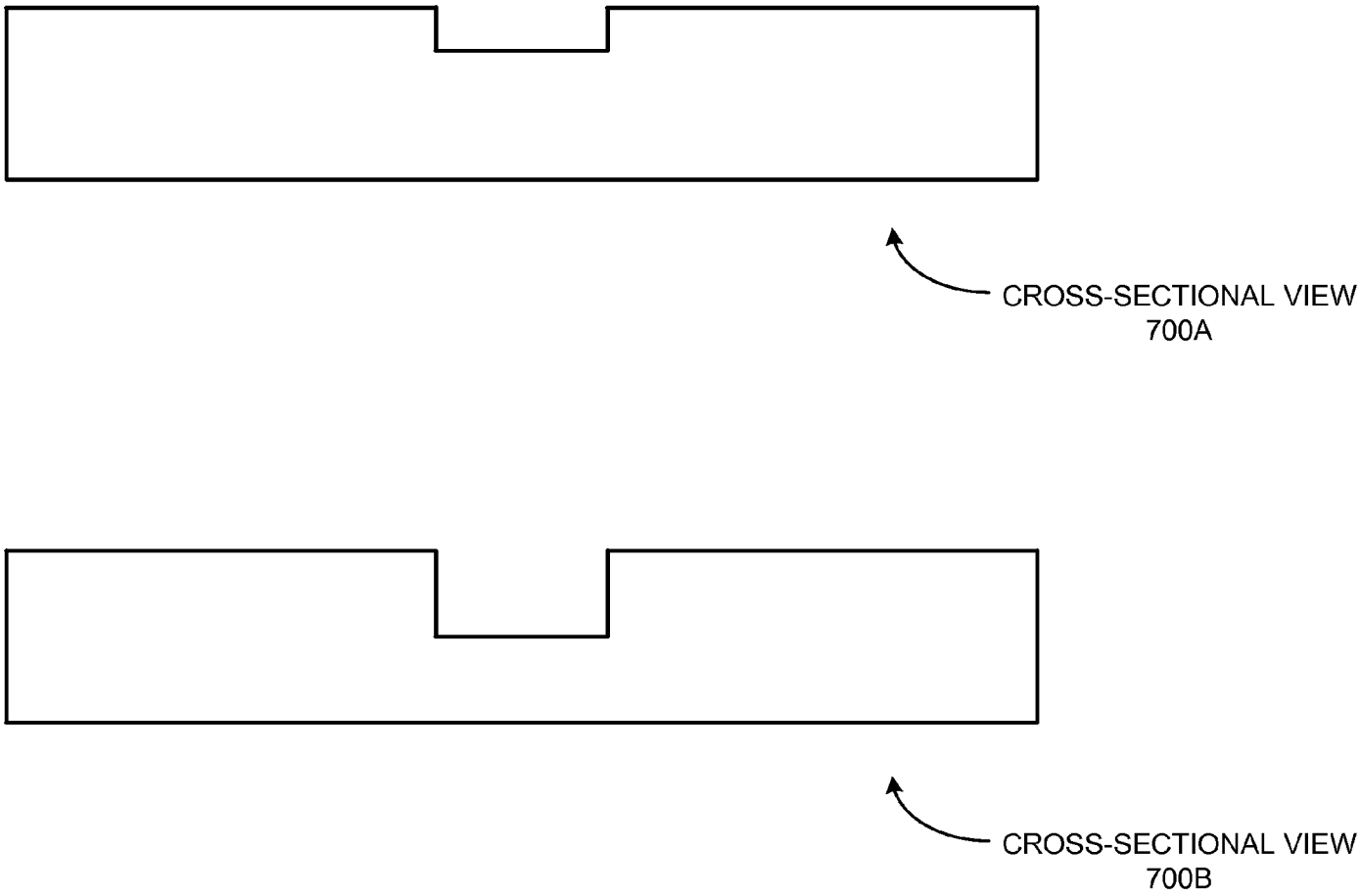
FIG. 7 illustrates two cross-sectional views of a marking surface in which one mark is of a greater depth than the other mark, according to one or more embodiments.

In the embodiment illustrated in FIG. 3A, the two beams are shown converging on the "2". The convergence of the two laser beams may assist in the generation of a deeper mark than that generated by a single laser beam. For example, a mark such as that created in the preferred embodiment of FIG. 3A may be approximately 200 μm deep, whereas a mark created by a single laser beam may only be 100 μm deep. FIG. 7 illustratively demonstrates the differences in depth between two marks as seen through a cross-sectional view of the marks. In addition, the convergence of the two laser beams may be useful to create a single mark in less time than that which would be created with a single laser. For example, the mark created in FIG. 3A may be completed in 0.025 seconds, whereas a mark created by a single laser beam may take 0.075 seconds to complete.

Figure 3B:
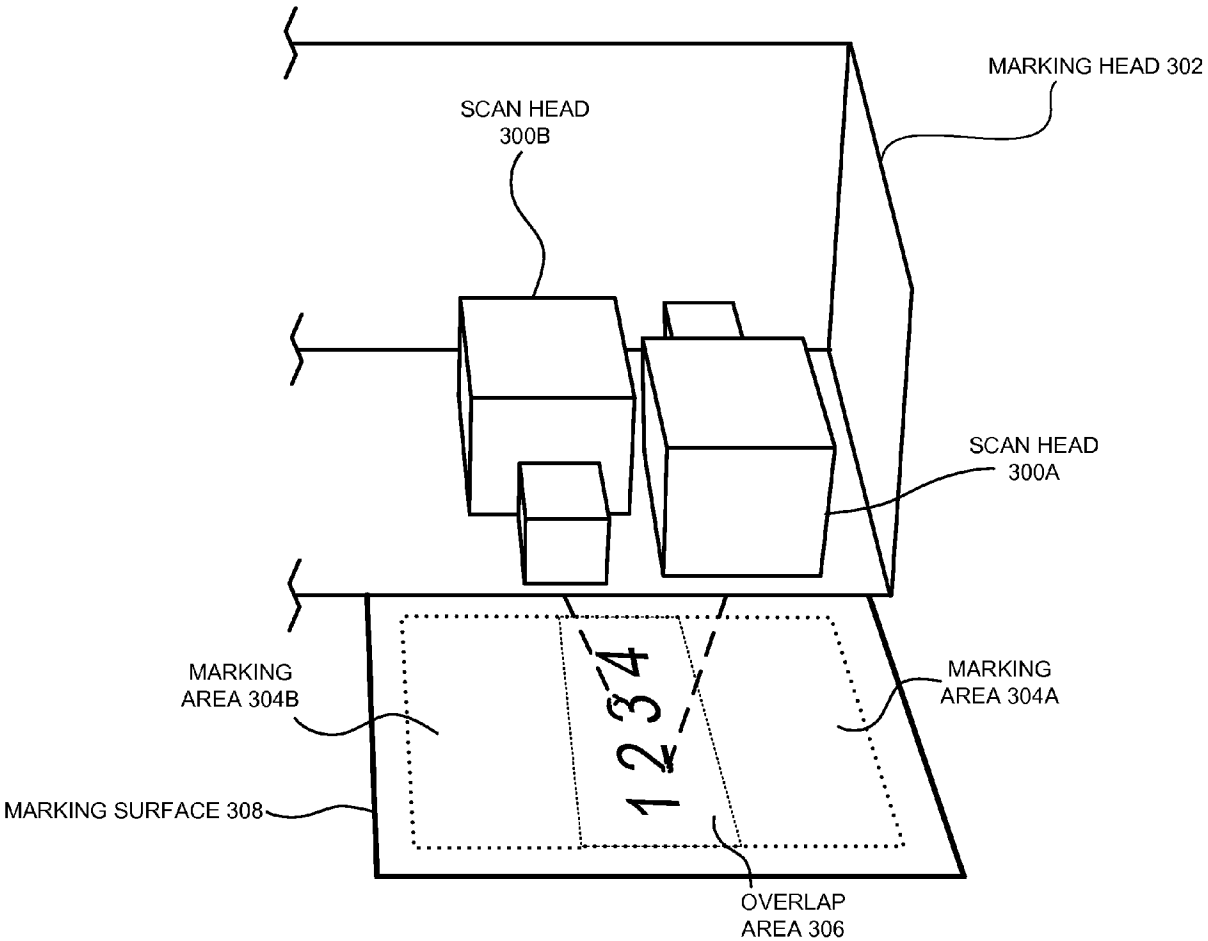
FIG. 3B is a cross-sectional view of the marking head comprising two scan heads that steer two laser beams that mark a marking surface at different location with disparate marks, according to one or more embodiments.

According to a second laser beam steering mode, the two laser beams are steered such that each marks a different location of the marking surface. Reference is now made to FIG. 3B which illustrates one embodiment of the second laser beam steering mode. In FIG. 3B, the two laser beams are collectively marking the marking surface 308, but each laser beam is marking a different location of the marking surface 308 and is ultimately creating a mark that is unique from the mark created by the other laser beam. For example, as shown in FIG. 3B, the laser beam steered by scan head 300A of a marking head 302 marked a "1" on the marking surface 308, and the laser beam steered by scan head 300B of the marking head 302 marked a "4" on the marking surface 308. FIG. 3B displays the two laser beams marking a "2" and a "3" separately on the marking surface 308. In particular, the laser beam steered by scan head 300A is marking the "2," and the laser beam steered by scan head 300B is marking the "3." In essence, each laser beam is creating two distinct marks: a "1 2" mark and a "3 4" mark. However, the "1 2 3 4" mark may also be considered to be one collective mark in which each laser beam creates a part of the mark, the parts being "1 2" and "3 4".

The laser beam steering mode may dictate how the mark is to be created. Specifically, it may guide which laser beam will create the first part of the mark and which laser beam will create the second part of the mark. This information may be transmitted from the data processing device to the laser controller in the form of a data signal. The laser controller subsequently may convert the data signal to one or more digital input signals. The digital input signal(s) may configure the galvanometer scanners of the scan heads 300A-B such that when the laser beams are steered, they create one or more marks on the marking surface 308 according to the specified laser beam steering mode. As a result, several parts of the mark to be created are designated to be marked by separate beams or two unique marks are created, each by one laser beam.

In an alternative embodiment of the second laser beam steering mode, the two laser beams each create the same mark at around the same time. The resulting engravings are two identical marks. For example, the second laser beam steering mode may result in a configuration of the galvanometer scanners of the scan heads in which a laser beam steered by each scan head creates a mark that reads "ABCD". Thus, the end product is two separate marks that both read "ABCD" on different locations of the marking surface.

In yet another alternative embodiment of the second laser beam steering mode, the laser beams are steered to create two uniquely distinct marks at approximately the same time. For example, the first laser beam may be steered to create a mark that reads "DOG". The second laser beam may be steered to create a mark that reads "CAT". Both marks may be generated at approximately the same time and may be at different locations on the marking surface, but within the marking area of each scan head.

Figure 4:
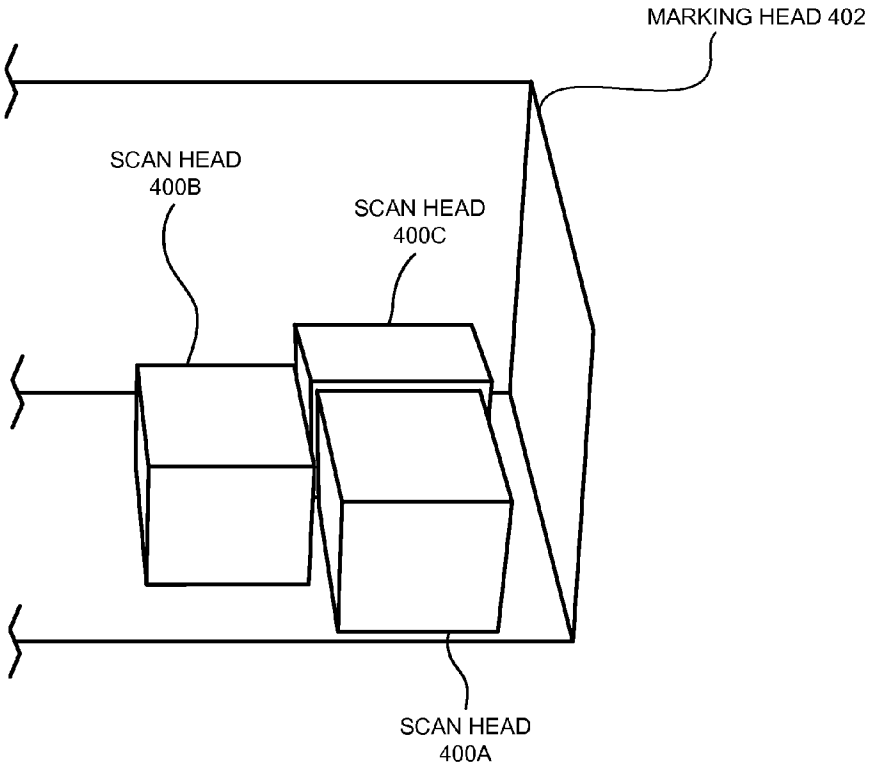
FIG. 4 is a cross-sectional view of a marking head comprising multiple scan heads, according to one or more embodiments.

Reference is now made to FIG. 4, which is a cross-sectional view of a marking head 402 comprising multiple scan heads 400A-C, according to one or more embodiments. Another preferred embodiment of a marking head of a laser marking system may include three or more scan heads. The additional scan head(s) may comprise galvanometer scanners that function in the manner that was previously described. Overall, the additional scan head(s) may each steer a laser beam for the creation of a mark separate from that created by the other laser beams.

Figure 5:
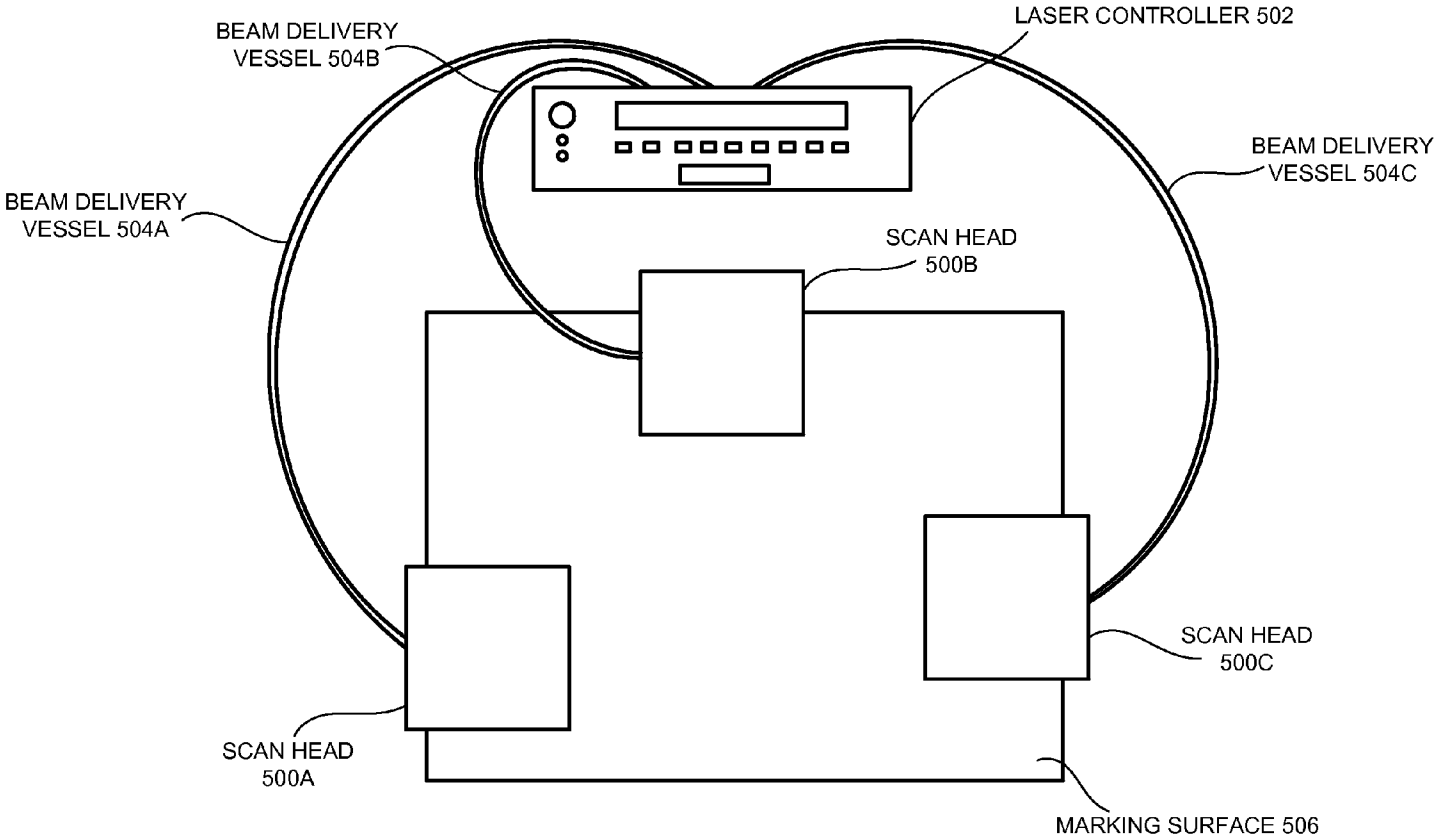
FIG. 5 is a schematic diagram of a laser controller coupled to multiple scan heads of one or more marking head for the marking of different areas of a marking surface, according to one or more embodiments.

The arrangement of the scan heads 400A-C depicted in FIG. 4 is an exemplary embodiment. However, other positional arrangements and number of scan heads are within the scope of this exemplary embodiment. An illustration of another arrangement of multiple scan heads of a laser marking systems can be seen in FIG. 5. For example, FIG. 5 portrays a laser marking system in which a laser controller 502 is coupled to three scan heads 500A-C individually via three beam delivery vessels 504A-C. Specifically, scan head 500A is coupled to the laser controller 502 via beam delivery vessel 504A; scan head 500B is coupled to the laser controller 502 via beam delivery vessel 504B; and scan head 500C is coupled to the laser controller 502 via beam delivery vessel 504C. The scan heads 500A-C are arranged over different locations of a marking surface 506 so that the mark(s) may be created at each location at around the same time.

Figure 2B:
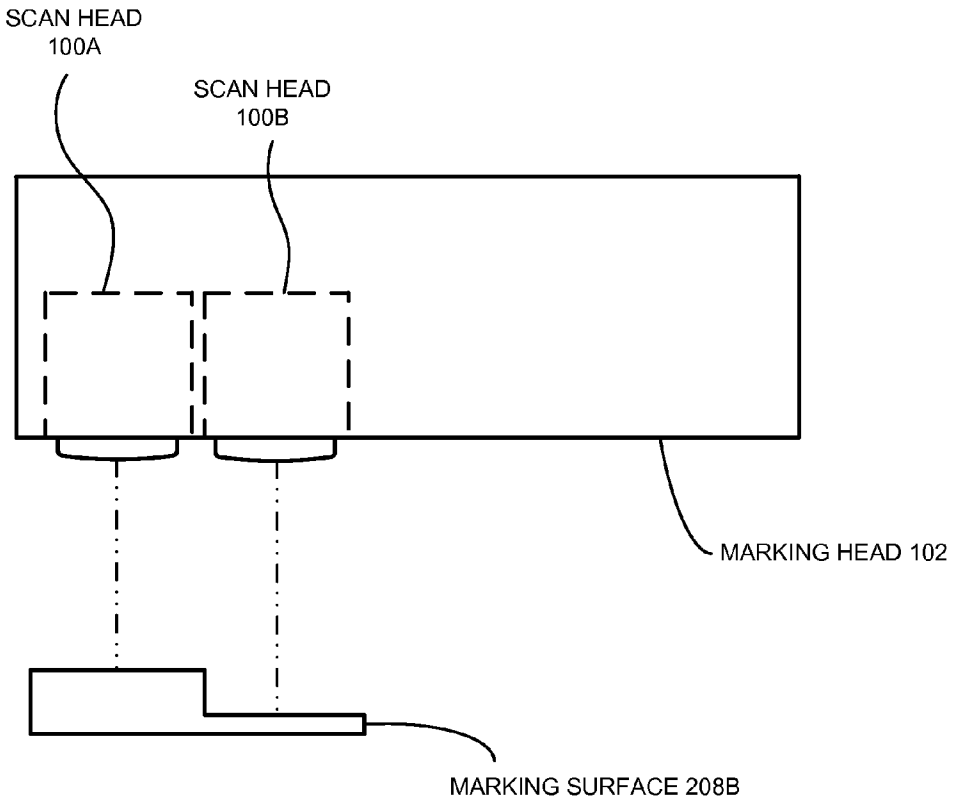
FIG. 2B is a view of the marking head of FIG. 2A, depicting a variable marking surface to be marked with beams of differing focal lengths, according to one or more embodiments.
Figure 6A:
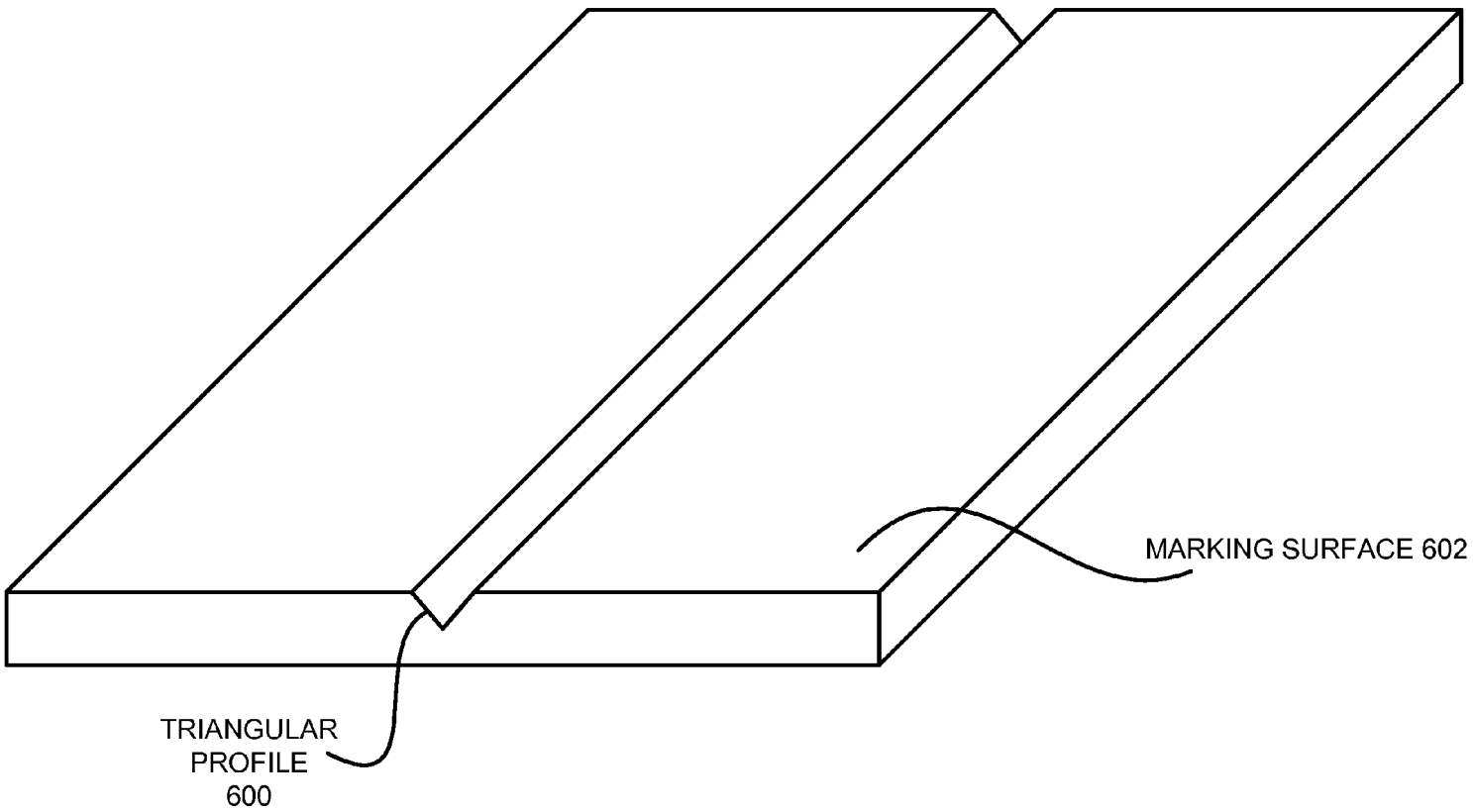
FIG. 6A is a perspective view of a marking surface, specifically depicting a marking with a triangular profile, according to one or more embodiments.
Figure 6B:
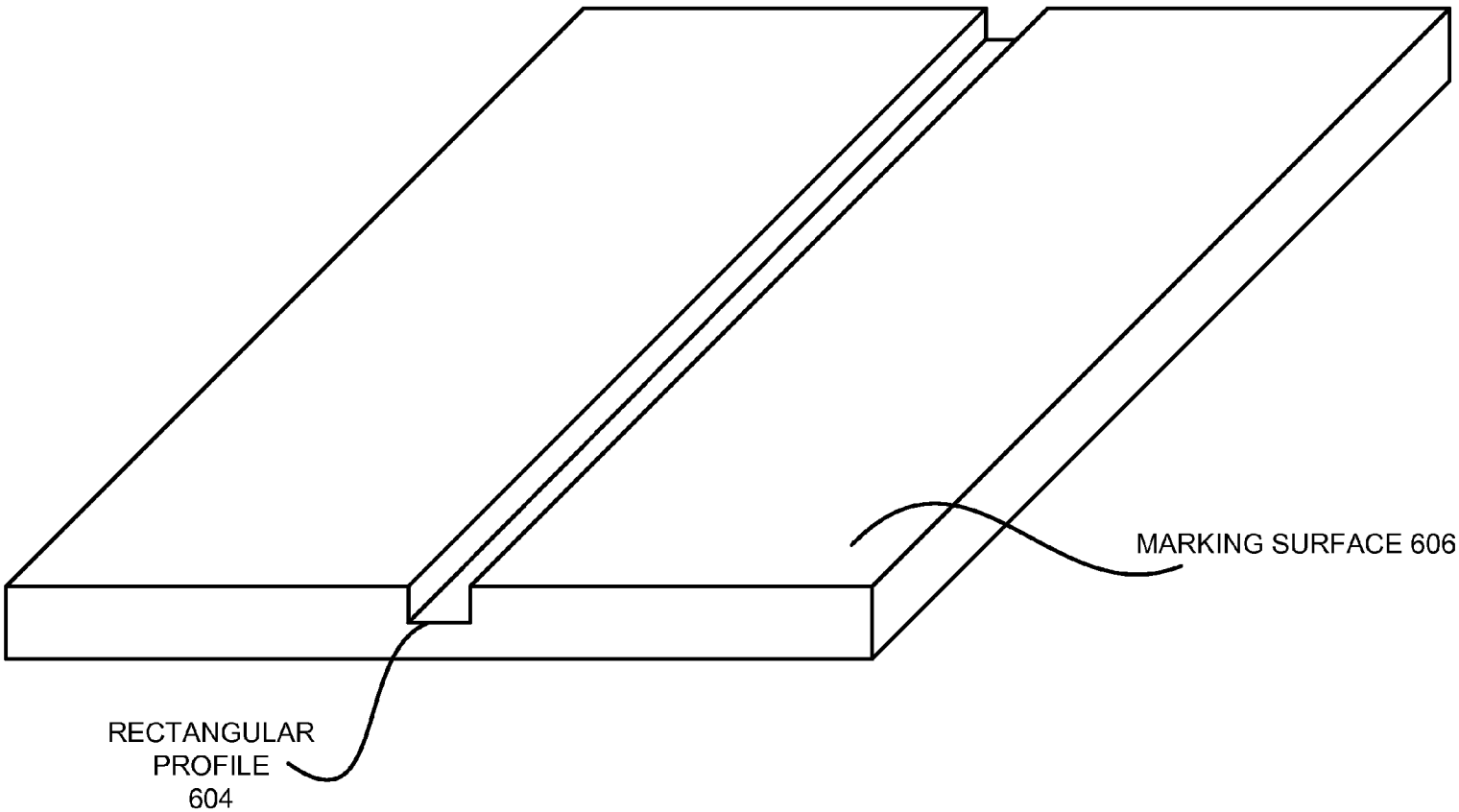
FIG. 6B is a perspective view of a marking surface, portraying a marking with a rectangular profile, according to one or more embodiments.

The exemplary embodiments disclosed herein provide for a method, system, and/or device for the collective marking of a surface by two or more laser beams generated by a laser controller. Apart from the differences in the marks that each laser beam may create, each laser beam may differ in one or more characteristics from the other laser beam(s). For example, in a laser marking system with two scan heads, two laser beams are independently steered by the scan heads. The first laser beam may differ in power level, pulse width, focal length, and/or wavelength from that of the second laser beam. The difference in beam characteristics may be utilized to create different types of marks on differing surfaces. For instance, a mark may have a triangular profile 600 (as shown in FIG. 6A) on a marking surface 602. Alternatively, a mark may have a rectangular profile 604 (as shown in FIG. 6B) on a marking surface 606. In another example, as depicted in FIG. 2B, a marking surface 208B with disparate elevation across its surface may require the use of lasers beam of differing focal lengths. The laser beam steered by scan head 100B may be of a greater focal length than that of the laser beam steered by scan head 100A. Overall, various beam characteristics may be responsible for the disparate marking profiles and focal lengths. In addition, the beams may differ in characteristics that affect the width of the mark. One laser beam may create a mark that is wider or less wide than a mark created by another laser beam generated by the same laser controller.

Figure 8:
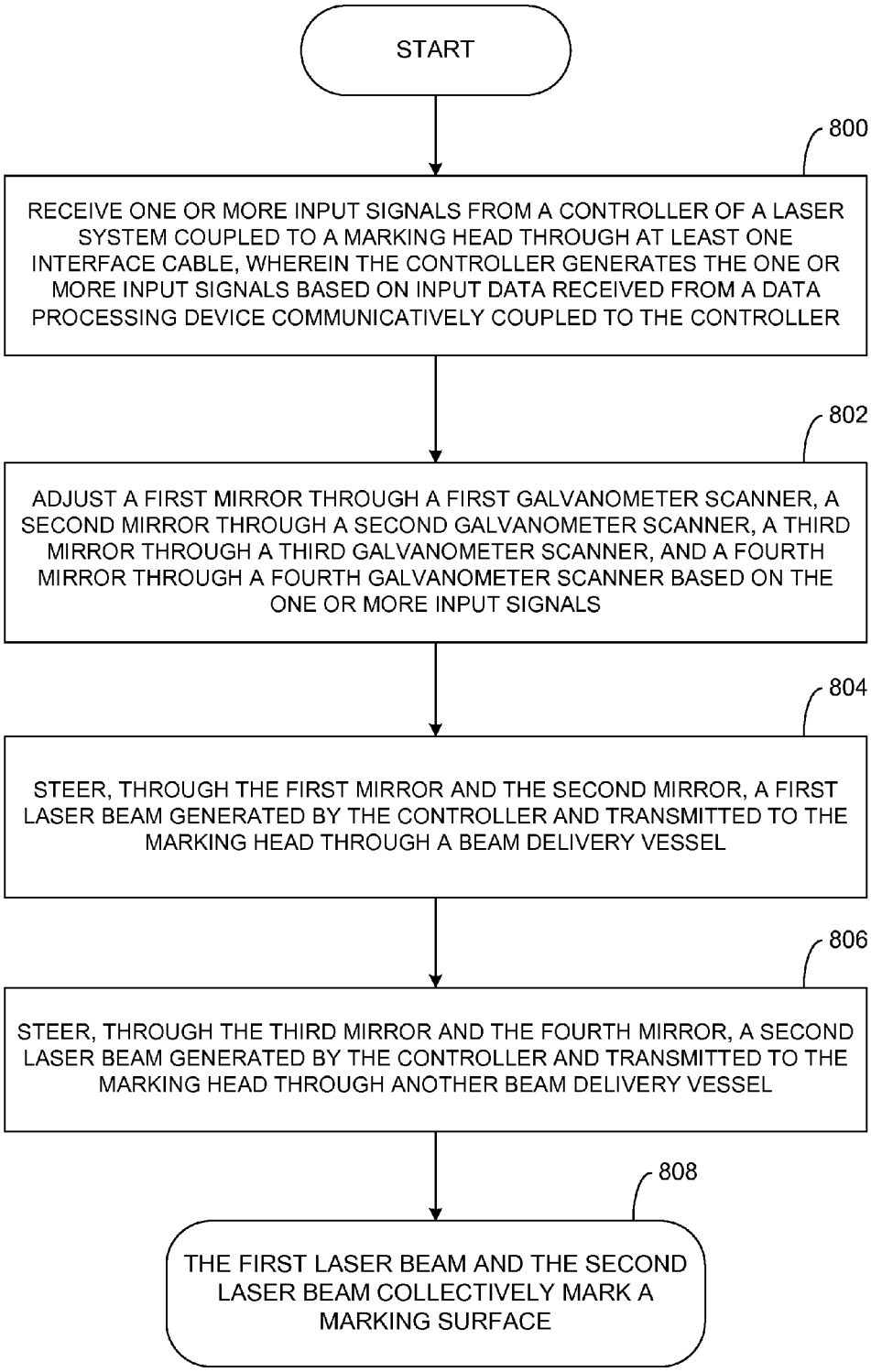
FIG. 8 is a process flow diagram listing the steps for marking a surface with two laser beams at approximately the same time, according to one or more embodiments.

FIG. 8 is a process flow diagram listing the steps for marking a surface with two laser beams at approximately the same time, according to one or more embodiments. Operation 800 discusses receiving one or more input signals from a controller of a laser system coupled to a marking head through an interface cable, wherein the controller generates the input signal(s) based on input data received from a data processing device communicatively coupled to the controller. Operation 802 discusses adjusting a first minor through a first galvanometer scanner, a second mirror through a second galvanometer scanner, a third minor through a third galvanometer scanner, and a fourth minor through a fourth galvanometer scanner based on the one or more input signals. Operation 804 discusses steering, through the first mirror and the second minor, a first laser beam generated by the controller and transmitted to the marking head through a beam delivery vessel. Operation 806 discusses steering through the third mirror and the fourth minor, a second laser beam generated by the controller and transmitted to the marking head through another beam delivery vessel. Operation 808 discloses the outcome of the process discussed in operations 800-806.

In addition, it will be appreciated that the various operations, processes and methods disclosed herein may be embodied in a non-transitory machine-readable medium and/or a machine-accessible medium compatible with a data processing system (e.g., data processing device 200). Accordingly, the specification and drawings are to be regarded in an illustrative rather than a restrictive sense.

The structures and modules in the figures may be shown as distinct and communicating with only a few specific structures and not others. The structures may be merged with each other, may perform overlapping functions, and may communicate with other structures not shown to be connected in the figures. Accordingly, the specification and/or drawings may be regarded in an illustrative rather than a restrictive sense.

What is claimed is:

1. A method of a marking head of a laser system, comprising:

receiving one or more input signals from a controller of the laser system coupled to the marking head through at least one interface cable, wherein the controller generates the one or more input signals based on input data received from a data processing device communicatively coupled to the controller;

adjusting a first minor through a first galvanometer scanner, a second minor through a second galvanometer scanner, a third minor through a third galvanometer scanner, and a fourth mirror through a fourth galvanometer scanner based on the one or more input signals;

steering, through the first minor and the second minor, a first laser beam generated by the controller and transmitted to the marking head through a beam delivery vessel; and steering, through the third minor and the fourth minor, a second laser beam generated by the controller and transmitted to the marking head through another beam delivery vessel, wherein the first galvanometer scanner, the second galvanometer scanner, the third galvanometer scanner, and the fourth galvanometer scanner are configured by the one or more input signals to steer the first laser beam and the second laser beam such that the first laser beam and the second laser beam collectively mark a marking surface.

2. The method of claim 1, wherein the input data comprises data instructing the controller to configure the one or more input signals based on a laser beam steering mode, wherein the laser beam steering mode involves the generation of at least one of:

a mark made through a convergence of the first laser beam and the second laser beam at a convergence point on the marking surface, wherein the convergence point lies within an area of overlap, wherein the area of overlap is a region on the marking surface where both the first laser beam and the second laser beam can be steered to mark the marking surface; and two marks made at around the same time, wherein one mark is created by the first laser beam and another mark is created by the second laser beam.

3. The method of claim 2, wherein the two marks are unique markings distinct from one another.

4. The method of claim 2, wherein the two marks are equivalent marks.

5. The method of claim 1:

wherein the marking head steers, through one or more additional mirrors, one or more additional laser beams generated by the controller, and wherein the one or more additional mirrors are adjusted by one or more additional galvanometer scanners.

6. The method of claim 1, wherein:

the first laser beam and the second laser beam, combined, achieve a marking depth greater than a marking depth achieved by the first laser beam and the second laser beam separately, and the marking depth achieved by the first laser beam and the second laser beam, combined, is achieved in less time than the marking depth achieved by the first laser beam and the second laser beam separately.

7. The method of claim 1, wherein the first laser beam and the second laser beam differ in at least one characteristic, wherein the at least one characteristic is at least one of a power level, a pulse width, and a wavelength.

8. A laser marking system to mark a marking surface, comprising:

a controller;

a data processing device communicatively coupled to the controller;

a marking head coupled to the controller through at least one interface cable, wherein the marking head further comprises:

a first mirror of a first galvanometer scanner, a second mirror of a second galvanometer scanner, a third mirror of a third galvanometer scanner, and a fourth minor of a fourth galvanometer scanner;

wherein the marking head is configured to:

receive one or more input signals from the controller, wherein the controller generates the one or more input signals based on input data received from the data processing device;

adjust the first mirror through the first galvanometer scanner, the second minor through the second galvanometer scanner, the third minor through the third galvanometer scanner, and the fourth minor through the fourth galvanometer scanner based on one or more input signals;

steer, through the first minor and the second mirror, a first laser beam generated by the controller and transmitted to the marking head through a beam delivery vessel; and steer, through the third minor and the fourth minor, a second laser beam generated by the controller and transmitted to the marking head through another beam delivery vessel, wherein the first galvanometer scanner, the second galvanometer scanner, the third galvanometer scanner, and the fourth galvanometer scanner are configured by the one or more input signals to steer the first laser beam and the second laser beam such that the first laser beam and the second laser beam collectively mark the marking surface, and wherein the input data comprises data instructing the controller to configure the one or more input signals based on a laser beam steering mode, wherein the laser beam steering mode involves the generation of at least one of:

a mark made through a convergence of the first laser beam and the second laser beam at a convergence point on the marking surface, wherein the convergence point lies within an area of overlap, wherein the area of overlap is a region on the marking surface where both the first laser beam and the second laser beam can be steered to mark the marking surface; and two marks made at around the same time, wherein one mark is created by the first laser beam and another mark is created by the second laser beam.

9. The laser marking system of claim 8, wherein the two marks created by the first laser beam and the second laser beam are unique markings distinct from one another.

10. The laser marking system of claim 8, wherein the two marks are equivalent marks.

11. The laser marking system of claim 8:

wherein the marking head steers, through one or more additional mirrors, one or more additional laser beams generated by the controller, and wherein the one or more additional mirrors are adjusted by one or more additional galvanometer scanners.

12. The laser marking system of claim 8, wherein:

the first laser beam and the second laser beam, combined, achieve a marking depth greater than a marking depth achieved by the first laser beam and the second laser beam separately, and the marking depth achieved by the first laser beam and the second laser beam, combined, is achieved in less time than the marking depth achieved by the first laser beam and the second laser beam separately.

13. The laser marking system of claim 8, wherein the first laser beam and the second laser beam differ in at least one characteristic, wherein the at least one characteristic is at least one of a power level, a pulse width, and a wavelength.

14. A non-transitory medium, readable through a processor of a data processing device, the data processing device communicatively coupled to a controller of a laser marking device, including instructions embodied therein that are executable through the processor, comprising:

instructions to adjust a first minor through a first galvanometer scanner of the laser marking device, a second mirror through a second galvanometer scanner of the laser marking device, a third mirror through a third galvanometer scanner of the laser marking device, and a fourth mirror through a fourth galvanometer scanner of the laser marking device based on input data;

instructions to transmit a sequence of values, through the controller, to the first galvanometer scanner and the second galvanometer scanner to steer, through the first minor and the second mirror, a first laser beam generated by the controller and transmitted to a marking head of the laser marking device through a beam delivery vessel; and instructions to transmit another sequence of values, through the controller, to the third galvanometer scanner and the fourth galvanometer scanner to steer, through the third minor and the fourth minor, a second laser beam generated by the controller and transmitted to the marking head through another beam delivery vessel, wherein the first galvanometer scanner and the second galvanometer scanner are configured according to the sequence of values and the third galvanometer scanner and the fourth galvanometer scanner are configured according to the another sequence of values to steer the first laser beam and the second laser beam, respectively, such that the first laser beam and the second laser beam collectively mark the marking surface, and wherein the sequence of values and the another sequence of values are configured by the input data stored in the data processing device to correspond to a laser beam steering mode, wherein the laser beam steering mode involves the generation of at least one of:

a mark made through a convergence of the first laser beam and the second laser beam at a convergence point on the marking surface, wherein the convergence point lies within an area of overlap, wherein the area of overlap is a region on the marking surface where both the first laser beam and the second laser beam can be steered to mark the marking surface; and two marks made at around the same time, wherein one mark is created by the first laser beam and another mark is created by the second laser beam.

15. The non-transitory medium of claim 14, wherein the two marks created by the first laser beam and the second laser beam are unique markings distinct from one another.

16. The non-transitory medium of claim 14, wherein the two marks are equivalent marks.

17. The non-transitory medium of claim 14 further comprises:

instructions to transmit an additional sequence of values, through the controller, to one or more additional galvanometer scanners to steer, through one or more additional minors, one or more additional laser beams generated by the controller.

18. The non-transitory medium of claim 14, wherein:

the first laser beam and the second laser beam, combined, achieve a marking depth greater than a marking depth achieved by the first laser beam and the second laser beam separately, and the marking depth achieved by the first laser beam and the second laser beam, combined, is achieved in less time than the marking depth achieved by the first laser beam and the second laser beam separately.

19. The non-transitory medium of claim 14, wherein:

the first laser beam and the second laser beam achieve a marking depth greater than that achieved by a single laser beam, wherein the marking depth is achieved in less time than that achieved by the single laser beam; and the first laser beam and the second laser beam differ in at least one characteristic, wherein the at least one characteristic is at least one of a power level, a pulse width, and a wavelength.

20. The non-transitory medium of claim 14, wherein the instructions further comprise:

instructions to allocate the input data such that the first galvanometer scanner and the second galvanometer scanner are allocated the sequence of values and the third galvanometer scanner and the fourth galvanometer scanner are allocated the another sequence of values for the generation of two separate marks.

* * * * *